US007950846B2

(12) United States Patent
Hessler et al.

(10) Patent No.: US 7,950,846 B2
(45) Date of Patent: May 31, 2011

(54) COUPLED RESONATORS FOR A TIMEPIECE

(75) Inventors: Thierry Hessler, Saint-Aubin (CH); Kaspar Trumpy, Soleure (CH); Jean-Luc Helfer, Bienne (CH); Thierry Conus, Lengnau (CH)

(73) Assignee: The Swatch Group Research and Development Ltd, Marin (CH)

( * ) Notice: Subject to any disclaimer, the term of this patent is extended or adjusted under 35 U.S.C. 154(b) by 19 days.

(21) Appl. No.: 12/497,136

(22) Filed: Jul. 2, 2009

(65) Prior Publication Data

US 2010/0002548 A1 Jan. 7, 2010

(30) Foreign Application Priority Data

Jul. 4, 2008 (EP) ..... 08159759

(51) Int. Cl.
*G04B 17/06* (2006.01)

(52) U.S. Cl. ..... 368/169; 368/127

(58) Field of Classification Search ..... 368/127–133, 368/169–178
See application file for complete search history.

(56) References Cited

U.S. PATENT DOCUMENTS

| | | | | |
|---|---|---|---|---|
| 1,232,285 | A * | 7/1917 | Greeley | 368/132 |
| 3,186,157 | A * | 6/1965 | Favret et al. | 368/175 |
| 3,528,237 | A * | 9/1970 | Suard | 368/175 |
| 3,600,973 | A | 8/1971 | Haag | |
| 3,631,669 | A * | 1/1972 | Fellrath et al. | 368/170 |
| 3,645,089 | A * | 2/1972 | Yamada | 368/128 |

FOREIGN PATENT DOCUMENTS

| | | | |
|---|---|---|---|
| CH | 276 465 | A | 7/1951 |
| EP | 1843227 | A | 10/2007 |
| FR | 563 314 | A | 12/1923 |
| FR | 2021817 | A | 7/1970 |

OTHER PUBLICATIONS

Partial Machine Translation of CH 276465—Source—gb.espacenet.com; Sep. 20, 2010.*

* cited by examiner

*Primary Examiner* — Sean Kayes

(74) *Attorney, Agent, or Firm* — Sughrue Mion, PLLC

(57) ABSTRACT

The resonator (1) for a timepiece results from coupling a first, low frequency resonator (2) with a second, higher frequency resonator (3). The first resonator (2) has a first balance (4) associated with a first balance spring (5). The second resonator (3) has a second balance (6) associated with a second balance spring (7). A third balance spring is arranged between the first (4) and second (6) balances to couple said first (2) and second (3) resonators.

6 Claims, 5 Drawing Sheets

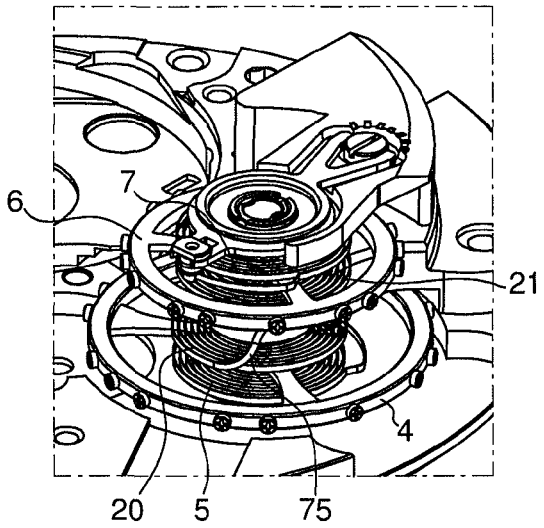
Fig. 5
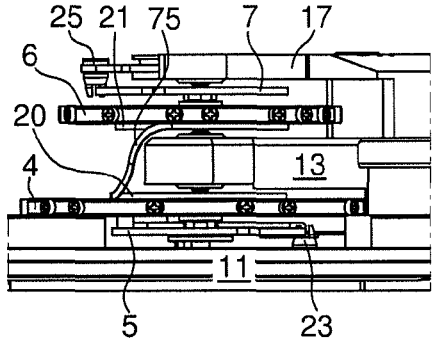
Fig. 6
Fig. 7
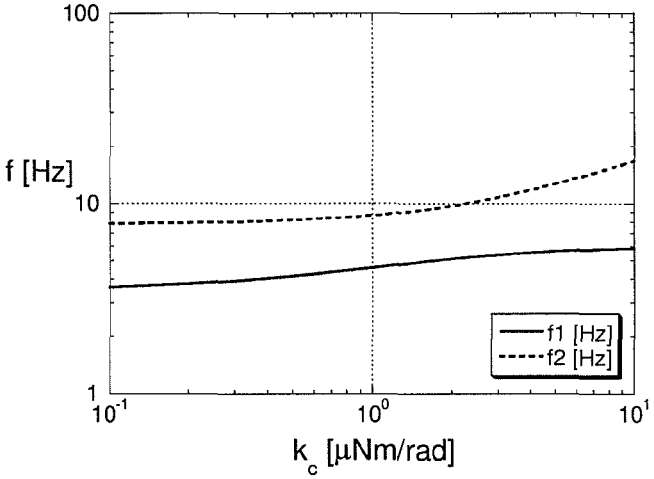
Fig. 8
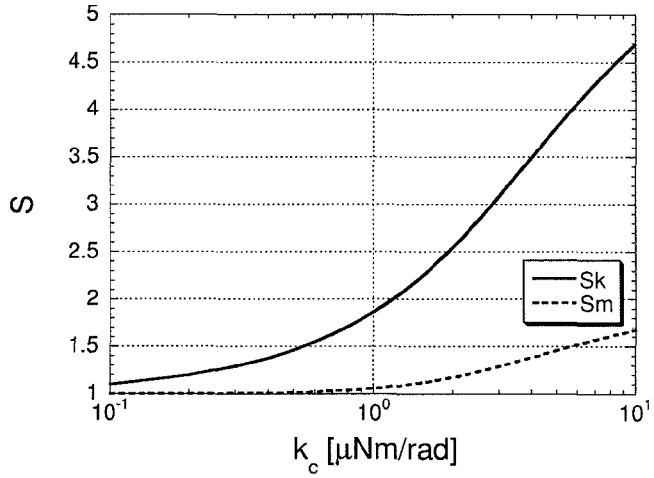

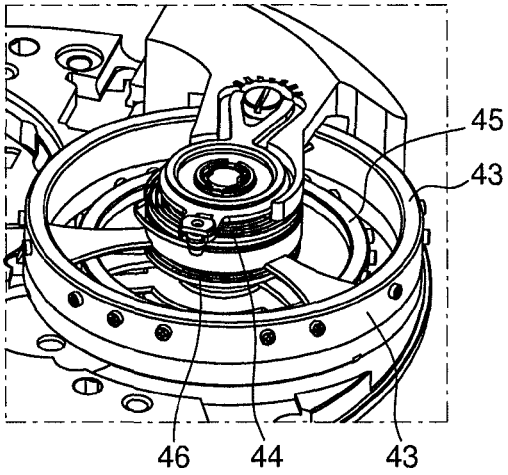
Fig. 12
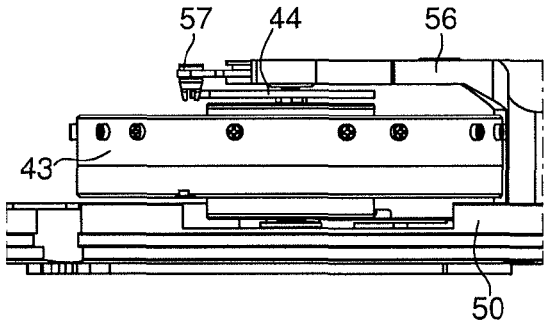
Fig. 13
Fig. 14
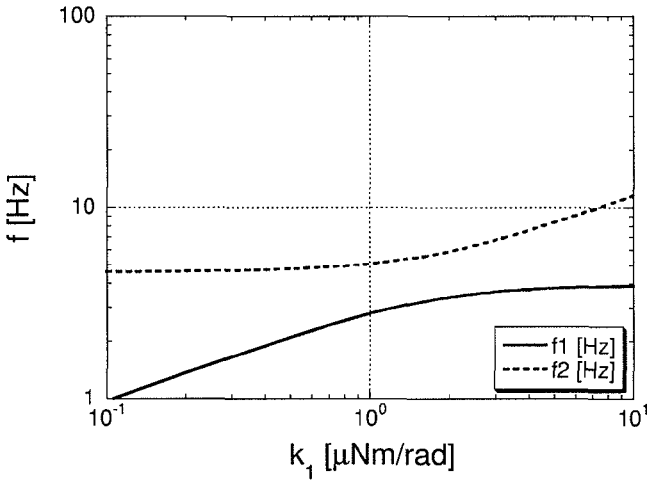
Fig. 15
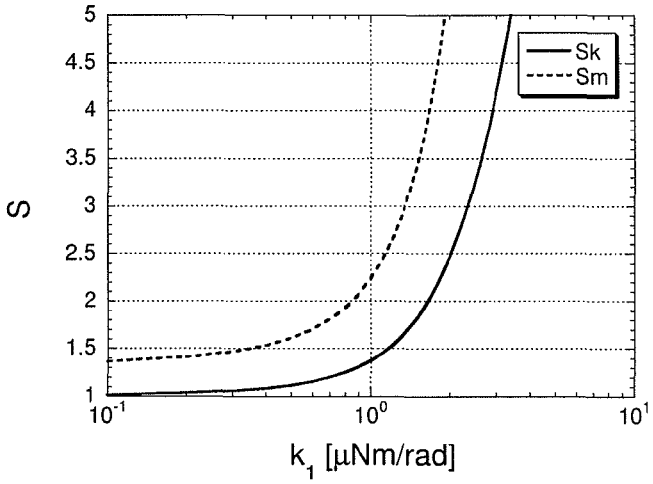

COUPLED RESONATORS FOR A TIMEPIECE

The present invention relates to a resonator for a timepiece that results from coupling a first, low frequency resonator to a second, higher frequency resonator.

A resonator answering the definition that has just been given was disclosed in EP Patent No. 1 843 227 A1. In this document, the first, low frequency resonator is a sprung balance and the second, high frequency resonator is a tuning fork. One branch of the tuning fork is directly connected to the outer coil of the balance spring to form the coupling between the two resonators. The object of this arrangement is to stabilise the operating frequency of the timepiece, to render the frequency more independent of external stress, and ultimately to improve the working precision of the timepiece. In the arrangement disclosed, the natural frequency of the first resonator is a few hertz, and that of the second resonator is of the order of a kHz. The idea is thus for a first resonator, which is very sensitive to external interference, to be enslaved by a second resonator, which, because of its high operating frequency, is much less sensitive to said interference. This slaving results in an improvement in the performance of the first resonator as regards shock resistance, for example, as said first resonator cooperates with a conventional escape system.

The embodiment that has just been described relies, however, on two resonators that are very different from each other, and whose coupling and adjustment might raise difficulties that, while not insurmountable, are nonetheless sufficiently great, given the low inertia of the high frequency resonator and thus its capacitance, to influence the working of the first, low frequency resonator.

Consequently, if the working of a first, low frequency resonator can be regulated using a sprung balance by means of a second, higher frequency resonator, also using a sprung balance, the operating frequency of the timepiece will have been stabilised to a certain point, by implementing resonators that hold no secrets for those skilled in the art.

In horology, hourly alternations of 18000, 21600 and 28800, corresponding to oscillation frequencies of 2.5, 3 and 4 Hz are commonly used for the sprung balance resonator. However, watches fitted with sprung balance resonators that oscillate at higher frequencies are known, the desired objective being to allow the watch to achieve a better chronometric performance when worn.

As the work "Echappement et Moteurs pas à pas", by Charles Huguenin et al (FET, Neuchâtel 1974, pages 137 to 148) shows, the fact of multiplying the frequency by two decreases the effect of a poising fault on the daily working of a timepiece by a factor of four. Thus, an increase in the oscillation frequency of the balance has the dual advantage of increasing the regulating power of the resonator and making the working of the watch less sensitive to changes of position.

These advantages must, however, be paid for by an increase in the number of teeth of the escape wheel. The conventional escape wheel generally has 15 teeth for sprung balance resonator frequencies of 2.5 to 3 Hz. This number has been accepted for a long time as it is, since it takes account of escape wheel manufacturing problems and proper distribution of the ratios and numbers of teeth of the wheels and pinions of the going train of the watch. With higher resonator frequencies of between 4 and 10 Hz, the gear ratios become too high, but this drawback disappears if the number of teeth in the escape wheel is increased. 21 teeth is the number cited for an oscillation frequency of 5 Hz, with this change however causing a reduction in security such as rest and drop, which require particular care during winding. Moreover, and generally, it is well known that the yield of a Swiss lever escapement greatly decreases beyond 4 or 5 Hz.

Thus, in order to benefit from the advantages of a high frequency resonator, it will be coupled to a low frequency resonator, which is controlled by a conventional escapement without increasing the number of the escape wheel teeth and with the well known level of security that this escapement provides.

This arrangement is shown in the block diagram of FIG. 1. In this Figure, the first, low frequency resonator 2.41 is formed by a sprung balance driven by an escapement and a going train 70, which is driven by a barrel 74. The time display 72, embodied by hands, for example, is derived from going train 70. The second, higher frequency resonator is represented by unit 3.42. The coupling between the two resonators is represented by the double arrow unit 8.46.

The present invention presents two embodiments, wherein the second embodiment is a particular case of the first embodiment.

In addition to satisfying the statement in the first paragraph of this description, the first embodiment is characterized in that the first resonator has a first inertia mass associated with a first spring, in that the second resonator includes a second inertia mass associated with a second spring and in that a third spring is arranged between the first and second inertia masses to couple said first and second resonators.

In addition to satisfying the statement in the first paragraph of this description, the second embodiment is characterized in that the first resonator includes a first inertia mass associated with a first spring, in that the second resonator includes a second inertia mass associated with a second balance spring and in that said second spring connects said first and second inertia masses to couples said first and second resonators.

The invention will now be explained in detail below, by means of drawings, which illustrate both of the aforementioned embodiments, wherein said embodiments are given by way of non-limiting example, and in which:

FIGS. 5 and 6 are perspective views of the resonator shown in plan and cross-section in FIGS. 3 and 4;

FIG. 7 is a graph showing the natural oscillation frequency of each of the resonators when the torque of the balance spring connecting the two resonators is varied;

Figure 9:
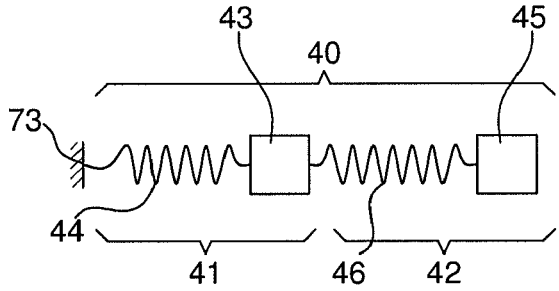
Figure 10:
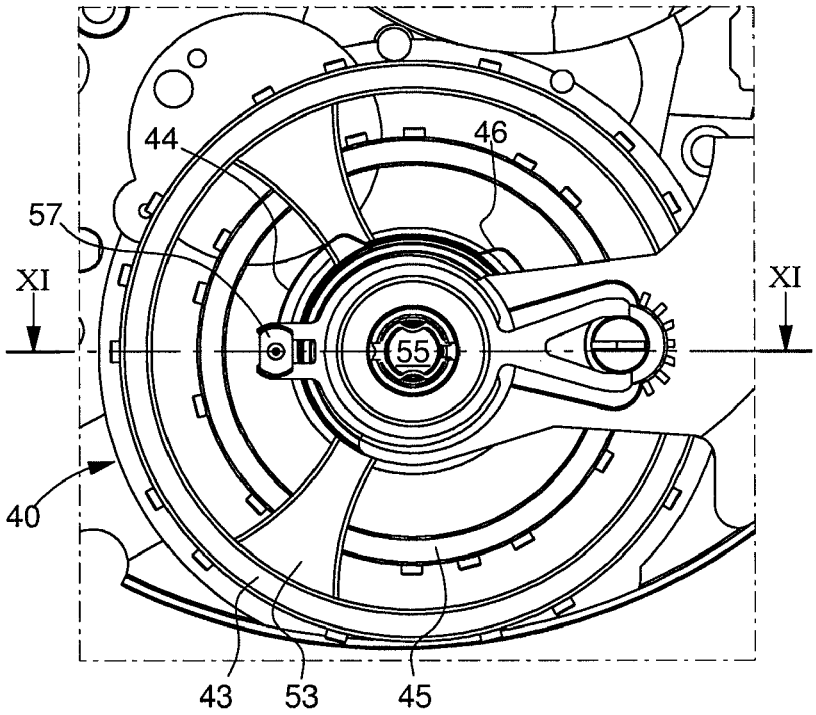
Figure 11:
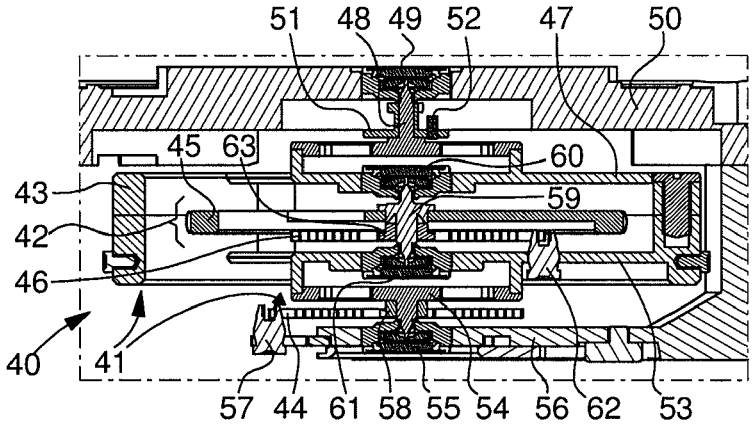

FIG. 8 is a graph showing the stabilising effect, resulting from coupling the first and second resonators, on interference that affects either the torque of the balance spring of the first resonator, or the inertia mass of the balance of said first resonator when the torque of the balance spring connecting the two resonators is varied, FIG. 9 is a similar diagram showing how the two resonators are arranged and coupled in accordance with the second embodiment of the invention, FIG. 10 is a plan view of the second embodiment of a resonator that results from coupling resonators, which are each formed of a sprung balance, FIG. 11 is a cross-section along the line XI-XI of FIG. 10, FIGS. 12 and 13 are perspective views of the resonator shown in plan and cross-section in FIGS. 10 and 11, FIG. 14 is a graph showing the natural oscillation frequency of each of the resonators when the torque of the balance spring of the first resonator is varied, and FIG. 15 is a graph showing the stabilising effect, resulting from the coupling of the first and second resonators, on interference that affects either the balance spring of the first resonator, or the inertia mass of the balance of said first resonator, when the torque of the balance spring of said first resonator is varied.

FIRST EMBODIMENT OF THE INVENTION

Figure 1:
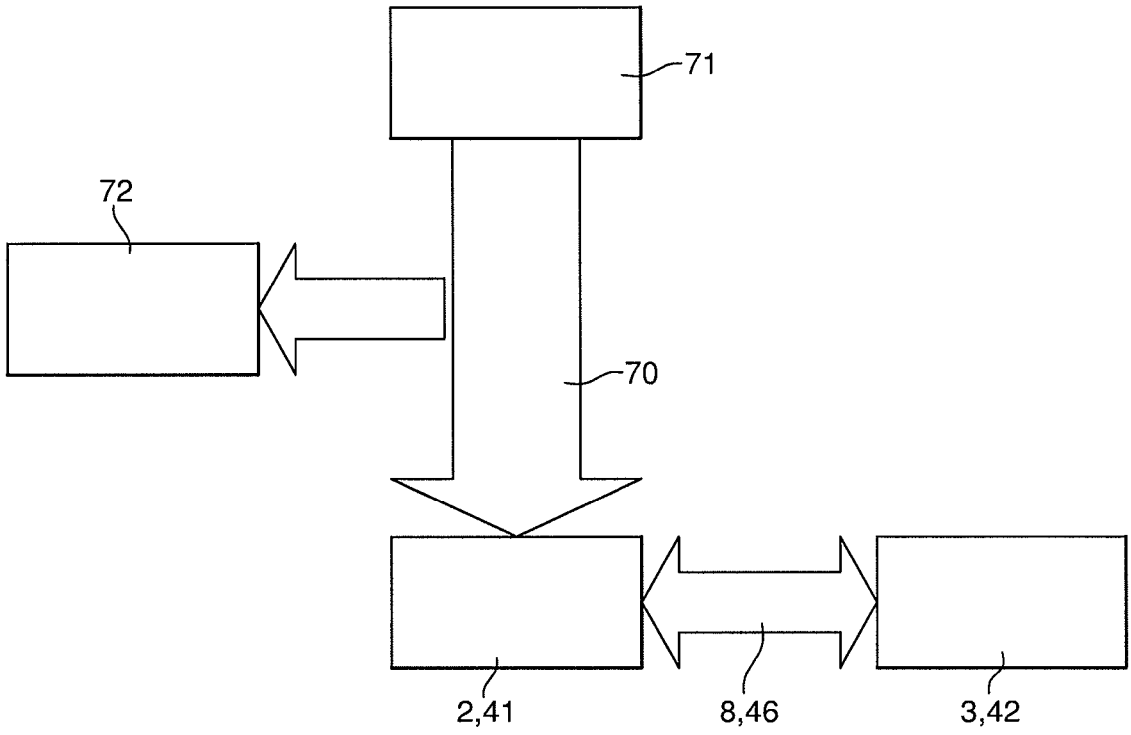
FIG. 1 is a block diagram illustrating the resonator of the invention and the involvement thereof in a timepiece.
Figure 2:
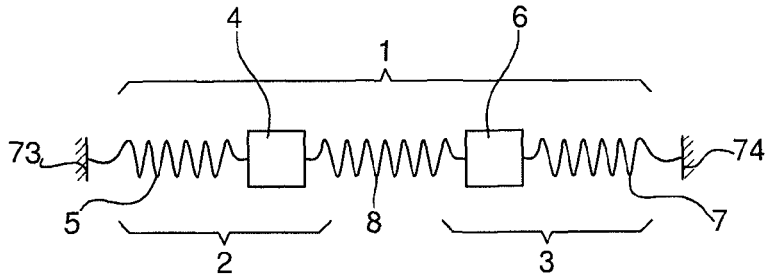
FIG. 2 is a similar diagram showing how the two resonators are arranged and coupled in accordance with the first embodiment of the invention.
Figure 3:
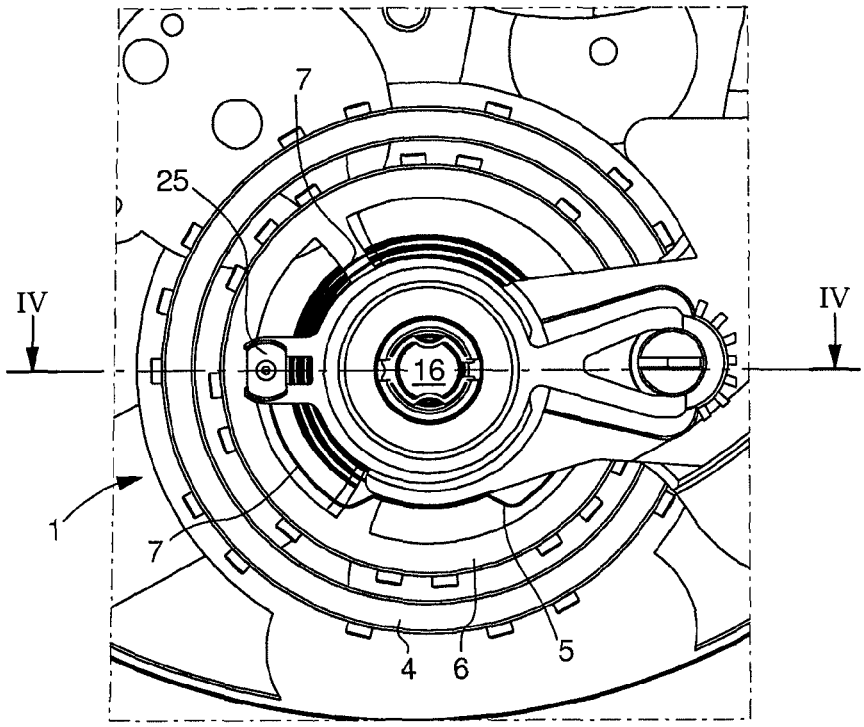
FIG. 3 is a plan view of the first embodiment of a resonator that results from coupling resonators that are each formed of a sprung balance.

Resonator 1, executed in according with the first embodiment of the invention, can be likened to the equivalent diagram of FIG. 2. This resonator 1 results from coupling a first resonator 2 with a second resonator 3. The first resonator 2 includes a first inertia mass 4 (illustrated here by a square mass), associated with a first spring 5 (illustrated here by a helical spring one end of which is attached to the square mass, and the other end of which is attached to a fixed part 73 of the timepiece, for example to the bottom plate). The second resonator 3 includes a second inertia mass 6 (illustrated here by a square mass) associated with a second spring 7 (illustrated here by a helical spring, one end of which is attached to the square mass and the other end of which is attached to a fixed part 74 of the timepiece, for example to a bridge). A third spring 8 (represented here by a helical spring) is arranged between the first (4) and second (6) inertia masses for coupling said first (2) and second (3) resonators.

FIGS. 3 to 6 illustrate a practical construction of the first embodiment of the invention. Here, the first and second inertia masses are respectively formed by first and second balances 4 and 6, and the first, second and third springs are respectively first, second and third balance springs 5, 7 and 8.

It can also be seen that, according to a preferred embodiment of the invention, the first and second resonators 2 and 3 are arranged coaxially to the inside of the timepiece between a bottom plate 11 and a bridge 17. The invention is not, however, limited to this arrangement, and the two resonators could, for example, be arranged side by side in the timepiece.

Figure 4:
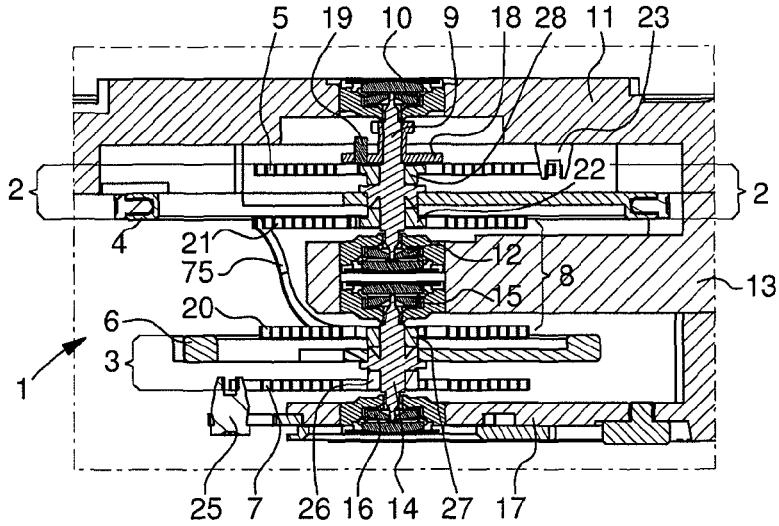
FIG. 4 is a cross-section along the line IV-IV of FIG. 3.

More specifically and as is shown clearly in FIG. 4, the first resonator 2 essentially includes a first balance 4, associated with a first balance spring 5. This first resonator 2 is mounted on a first arbour 9, which pivots at the first end thereof in a bearing 10, secured in a bottom plate 11 and at the second end thereof in a bearing 12, secured to an intermediate bridge 13. The outer and inner coils of the first balance spring 5 are respectively secured to a balance spring stud 23 carried by bottom plate 11 and on an inner point of attachment 28 secured to first arbour 9.

The second resonator 3 essentially includes a second balance 6, which is associated with a second balance spring 7. This second resonator 3 is mounted on a second arbour 14, which pivots at the first end thereof in a bearing 15, secured in intermediate bridge 13 and at the second end thereof in a bearing 16, secured in a bridge 17. The outer and inner coils of second balance spring 7 are respectively secured on a balance spring stud 25, carried by bridge 17, and on an inner point of attachment 26, secured to second arbour 14.

An examination of FIGS. 3 to 6 shows that the first resonator 2 includes a balance 4 that has a larger diameter than balance 6 of resonator 3, which indicates that the frequency of the first resonator is lower than the frequency of the second resonator, provided, of course, that the torque developed by each of the balance springs is approximately the same. In these conditions, it is clear that the escape mechanism will have to be connected to the first resonator, which will have to be enslaved by the second resonator in order to improve its resistance to interference. FIG. 4 shows that the first arbour 9 to which the first resonator 2 is attached, carries a roller 18 and an impulse pin 19, which cooperates, for example, with pallets, which cooperate in turn with an escape wheel.

The coupling that exists between resonators 2 and 3 now needs to be described. This coupling is achieved by means of a third balance spring 8. FIGS. 4 and 5 show that this balance spring 8 includes two windings 20 and 21 arranged in series and mounted on either side of intermediate bridge 13. In this manner, the inner coil of the first winding 20 is secured to an inner point of attachment 27, secured to the second arbour 14, whereas the inner coil of the second winding 21, is secured to an inner point of attachment 22, secured to the first arbour 9, the outer coils of said windings being connected to each other by a strip 75.

The invention is not limited to the description that has just been given. The third balance spring may, in fact, have only one winding. In such case, and without any need to show this in a drawing, the inner coil of this single winding is secured to a point of attachment 27, secured to the second arbour 14, whereas the outer coil is secured to a balance spring stud carried by the first balance 4.

We will now briefly show the advantage of coupling two resonators, one of which oscillates at a low frequency and the other at a higher frequency in order to make the resonator oscillating at a low frequency more stable.

A mechanical resonator formed of a mass and a spring is characterized by the weight of its mass m and the constant of its spring k which are expressed, in the equivalent diagram of FIG. 2 and in orders of magnitude relating to timepiece making, respectively in milligrams (mg) and micro-newtons per meter (μN/m). In the present case, mass m is a balance, characterized by its inertia mass expressed in milligrams per square centimeter (mg·cm2), and the constant k is relative to a balance spring, which is characterized by its unitary torque, expressed in micronewton meters per radian (μN·m/rad). Consequently, the frequency of a resonator is written as:

$$f = \frac{1}{2\pi}\sqrt{\frac{k}{m}}$$

To take an example from on a common timepiece calibre found on the market, $k=1\cdot10^{-6}$ Nm/rad and $m=16\cdot10^{-10}$ $kg\cdot m^2$, whence the frequency f=4 Hz.

The central question is to know whether the presence of the second, higher frequency resonator stabilises the frequency of the first, low frequency resonator. This effect is taken into account by the stabilising factor S defined by:

$$S = \frac{\omega_{1p} - \omega_1}{\omega_1}\frac{\Omega_1}{\Omega_{1p} - \Omega_1}$$

In this relation, in which $\omega_1$ is the normal angular frequency of the first resonator alone, $W_{1p}$ is the disturbed angular frequency of the first resonator alone $\Omega_1$ is the normal angular frequency of the coupled system and $\Omega_{1p}$ is the disturbed angular frequency of the coupled system. It will be clear that if stabilising factor S is equal to two, the timepiece is twice as precise with a coupled resonator system than with the first resonator alone. For example, a timepiece that runs ten seconds fast per day will only be five seconds fast for the same period.

A practical example will now be taken, implementing the first and second resonators having the following features:

Resonator 1: $m_1$=21 mg·cm$^2$, $k_1$=1 μN·m/rad hence $f_1$=3.47 Hz

Resonator 2: $m_2$=21 mg·cm$^2$, $k_2$=5 μN·m/rad hence $f_2$=7.75 Hz and these resonators being coupled by a mainspring with a constant $k_c$.

Referring to FIGS. 2 and 4, low frequency resonator 1 bears the reference 2, $m_1$ being balance 4, $k_1$ being the constant of balance spring 5. Resonator 2 with the higher frequency bears the reference 3, m2 being balance 6, $k_2$ being the constant of balance spring 7. It will be noted however that in this practical example, the balances have the same dimensions, which is not the case of the balances of FIG. 4, the second resonator having a higher natural frequency because of its spring constant, which is also higher.

Analytical calculations have set out the graphs of FIGS. 7 and 8 on the basis of the practical data stated above.

FIG. 7 is a graph showing the evolution of the natural frequencies $f_1$ and $f_2$ of the coupled resonator system as a function of constant $k_c$ of the balance spring that couples the two resonators.

FIG. 8 is a graph showing the evolution of stabilising factor S as a function of constant $k_c$ of balance spring 8 that couples the two resonators.

Curve $S_m$ shows the stabilising effect resulting from the coupling of the first and second resonators on interference that affects the inertia mass of the balance of the first, low frequency resonator when constant $k_c$ is varied. This effect is not very pronounced, which is relatively unimportant, since the inertia mass of the balance is unaffected by external interference.

Curve $S_k$ shows the stabilising effect resulting from coupling the first and second resonators on interference that affects the torque of the first resonator balance spring, namely the resonator driven by the escape system. It can be seen that for a value $k_c$ of 1 μNm/rad, the stabilising factor is not far off 2, which is positive, since the interference, due, among other things, to the position of the spring, shocks and temperature variations, affects the balance spring above all.

SECOND EMBODIMENT OF THE INVENTION

Resonator 40 executed in accordance with the second embodiment of the invention can be compared to the equivalent diagram of FIG. 9. Resonator 40 results from coupling a first resonator 41 with a second resonator 42. First resonator 41 has a first inertia mass 43 (illustrated here by a square mass) associated with a first spring 44 (illustrated here by a helical spring, one end of which is attached to the square mass and the other end of which is attached to a fixed part 73 of the timepiece, for example the bottom plate). The second resonator 42 has a second inertia mass 45 (illustrated here by a square mass) associated with a second spring 46 (illustrated here by a helical spring, one end of which is attached to square mass 43 and the other end of which is attached to square mass 45). This second balance spring 46 thus connects the first (43) and second (45) inertia masses to couple said first (41) and second (42) resonators. In fact, spring 46 plays a dual part here: it forms the second resonator 42 and couples the first and second resonators 41 and 42.

This second embodiment may be considered a particular case of the first embodiment. Indeed, if the third spring 7 and the attachment thereof to a fixed point 74 is removed from the first embodiment shown in FIG. 2, we are left with the equivalent diagram of FIG. 9, which illustrates the second embodiment, and which will now be explained in detail with reference to FIGS. 10 to 13.

FIGS. 10 to 13 illustrate a practical construction of the second embodiment of the invention. Here, as was already stated with reference to the first embodiment of the invention, the first and second inertia masses are respectively formed by first and second balances 43 and 45, and the first and second springs are respectively first and second balance springs 44 and 46.

It can also be seen that the first balance 43 has a circular cage which encloses the second, higher frequency resonator 42, said circular cage 43 forming the first, low frequency resonator 41, with the first balance spring 44.

As the cross-section of FIG. 11 clearly shows, the circular cage 43 forming the first balance is fitted with a first cheek 47 carrying a first trunnion 48, which pivots in a bearing 49 secured to a plate 50. This first trunnion 48 carries a roller 51 and an impulse pin 52, and the latter cooperates, for example, with pallets, which in turn cooperate with an escape wheel. The circular cage 43 is also fitted with a second cheek 53 carrying a second trunnion 54, which pivots in a bearing 55, secured in a bridge 56. Bridge 56 is fitted with a balance spring stud 57, to which the outer coil of the first balance spring 44 is fixed, the inner coil of said first balance spring 44 being fixed to an inner point of attachment 58, secured to the second trunnion 54. The circular cage or balance 43 and the balance spring 44 form the first, low frequency resonator 41, whose performance has to be improved.

FIG. 11 also shows that the second balance 45 and balance spring 46 forming the second resonator 42—and which is enclosed in cage 43—are carried by an arbour 59 that pivots at the first end thereof in a bearing 60 secured in the first cheek 47 of cage 43 and at the second end thereof in a bearing 61 secured in the second cheek 53 of the cage. Moreover, the outer and inner coils of the second balance spring 46 are respectively fixed to a balance spring stud 62 carried by the second cheek 53 of cage 43 and to an inner point of attachment 63, secured to arbour 59.

An examination of FIGS. 10 to 12 reveals that the first resonator 41 includes a balance or cage 43 with a larger diameter than that of balance 45 of the second resonator 42, which indicates that the frequency of the first resonator is lower than the frequency of the second resonator, and the torque developed by each of the balance springs is also equal. It will thus be clear that the escape mechanism will be connected to the first resonator, which has to be enslaved by the second resonator to improve its resistance to interference.

The advantage in coupling two resonators, one of which oscillates at a low frequency and the other at a higher frequency, in order to improve the performance of the resonator oscillating at a low frequency was demonstrated in the discussion of the first embodiment. We will not, therefore, return to the theory expounded, which also applies to the second embodiment that has just been described.

We will, however, take a practical example, namely:

Resonator 1: $m_1$=20 mg·cm$^2$, $k_1$=variable

Resonator 2: $m_2$=6.4 mg·cm$^2$, $k_c$=0.4 μN·m/rad, $k_2$=0

With reference now to FIGS. 9 and 11, low frequency resonator 1 bears the reference 41, $m_1$ being the balance or cage 43, $k_1$ being the constant of balance spring 44 and higher frequency resonator 2 bears the reference 42, $m_2$ being balance 45, $k_c$ being the constant of balance spring 46, $k_c$ also being the balance spring that couples the two resonators.

On the basis of the practical data stated above, the graphs of FIGS. 14 and 15 have been established by analytical calculations. The variable selected is no longer $k_c$ as in the first embodiment, but $k_1$ which appeared the most determining parameter.

FIG. 14 is a graph showing the evolution of the natural frequencies $f_1$ and $f_2$ of the coupled resonator system as a function of the constant $k_1$ of balance spring 44 forming first resonator 41.

FIG. 15 is a graph showing the evolution of the stabilising factor—which was defined above with reference to the first embodiment—as a function of the constant $k_1$ of mainspring 44 affecting first resonator 41.

Curve $S_m$ shows the stabilising effect resulting from coupling the first and second resonators 41 and 42 on interference that affects the inertia mass of the balance of the first, low frequency resonator 41 when the constant $k_1$ of balance spring 44 is varied. This effect is much more pronounced that the effect observed in relation to the first embodiment.

The curve $S_k$ shows the stabilising effect resulting from coupling the first and second resonators 41 and 42 on interference affecting the torque of the first balance spring 44 of first resonator 41. It can be seen that for a value of 2 μN·m/rad for $k_1$, the stabilising factor S is of the order of 2.5.

CONCLUSIONS

Both of the embodiments shown have demonstrated that the performance of a first, low frequency resonator, sprung balance resonator with a frequency of the order of 2 to 6 Hz, can be improved if it is coupled to a second, higher frequency, sprung balance resonator with a frequency of the order of 10 Hz. The first, low frequency resonator is more sensitive to some interference due, for example, to being worn or to shocks, than the second, higher frequency resonator. One could envisage the second resonator compensating for any heat variation and/or isochronism defect of the first resonator. Moreover, the first resonator easily cooperates with a usual escape system, whereas this is not the case of the second resonator. It is thus logical to couple the two resonators concerned in order to benefit both from the good adaptation of the first to the escape system and the high level of insensitivity of the second to the aforecited interference.

What is claimed is:

1. A resonator for a timepiece resulting from coupling a first, low frequency resonator with a second, higher frequency resonator, wherein the first resonator has a first inertia mass associated with a first spring, wherein the second resonator has a second inertia mass associated with a second spring, wherein a third spring is arranged between the first and second inertia masses to couple said first and second resonators, and wherein the first and second inertia masses are respectively formed by first and second balances and wherein the first, second and third springs are respectively first, second and third hairsprings, wherein said first balance and said first hairspring form a first regulating unit, wherein said second balance and said second hairspring form a second regulating unit and wherein said third hairspring couples said first and second regulation units.

2. The resonator according to claim 1, wherein the first and second resonators are arranged coaxially inside the timepiece.

3. The resonator according to claim 2, wherein the first balance spring of said first resonator and the second balance spring of said second resonator each have outer and inner coils, and wherein the first resonator is mounted on a first arbour that pivots at the first end thereof in a bearing fixed in a bottom plate and at the second end thereof in a bearing fixed in an intermediate bridge, the outer and inner coils of the first balance spring of said first resonator being respectively fixed to a balance spring stud carried by the bottom plate and on an inner point of attachment fixed to said first arbour and wherein the second resonator is mounted on a second arbour that pivots at the first end thereof in a bearing fixed in said intermediate bridge and at the second end thereof in a bearing fixed in a bridge, the outer and inner coils of the second balance spring of said second resonator being respectively fixed on a balance spring stud, carried by the bridge and on an inner point of attachment fixed to said second arbour.

4. The resonator according to claim 3, wherein the first arbour carries a roller and an impulse pin, said impulse pin cooperating with an escape mechanism.

5. The resonator according to claim 3, wherein the third balance spring includes two windings arranged in series and mounted on either side of the intermediate bridge, the inner coil of the first winding being secured to an inner point of attachment fixed to the second arbour and the inner coil of the second winding being secured to an inner point of attachment fixed to the first arbour.

6. A resonator for a timepiece resulting from coupling a first, low frequency resonator with a second, higher frequency resonator, wherein the first resonator has a first inertia mass associated with a first spring, wherein the second resonator has a second inertia mass associated with a second spring and wherein said second spring connects said first and second inertia masses to couple said first and second resonators, wherein the first and second inertia masses are respectively formed by first and second balances and wherein the first and second springs are respectively first and second balance springs, wherein the first balance has a circular cage that encloses the second, higher frequency resonator, said circular cage forming, with the first balance spring, the first low frequency resonator, wherein the first balance spring of said first resonator and the second balance spring of said second resonator each have outer and inner coils, and wherein the circular cage is fitted with a first cheek carrying a first trunnion that pivots in a bearing fixed in a bottom plate, said first trunnion carrying a roller and an impulse pin for cooperating with an escape mechanism, and wherein said circular cage is fitted with a second cheek carrying a second trunnion that pivots in a bearing fixed in a bridge, the latter being provided with a balance spring stud to which the outer coil of the first balance spring is fixed, the inner coil of said first balance spring being fixed to an inner point of attachment fixed to the second trunnion, and wherein the second balance and balance spring forming the second resonator are carried by an arbour that pivots at the first end thereof in a bearing fixed in the first cheek of the cage and at the second end thereof in a bearing fixed in the second cheek of the cage, the outer and inner coils of the second balance spring being respectively fixed to a balance spring stud carried by the second cheek of the cage and to an inner point of attachment fixed to the arbour.

* * * * *